US005932956A

United States Patent [19]

Dietze

[11] Patent Number: 5,932,956

[45] Date of Patent: Aug. 3, 1999

[54] CONDUCTIVE PINS FOR AN ILLUMINATION LAMP

[75] Inventor: Werner Dietze, Maienfeld, Switzerland

[73] Assignee: Bruno Dietze, Coburg, Germany

[21] Appl. No.: 08/918,862

[22] Filed: Aug. 26, 1997

[30] Foreign Application Priority Data

May 28, 1997 [DE] Germany ..... 197 22 244

[51] Int. Cl.[6] ..... H01J 5/50

[52] U.S. Cl. ..... 313/318.07; 313/318.05; 313/315; 439/617

[58] Field of Search ..... 313/318.01, 318.09, 313/318.12, 318.07, 318.05, 491, 623, 315, 316; 315/74; 439/602, 617

[56] References Cited

U.S. PATENT DOCUMENTS

| | | | |
|---|---|---|---|
| 2,147,584 | 2/1939 | Thomas | 315/74 |
| 4,139,794 | 2/1979 | Malm et al. | 313/318.01 |
| 4,398,124 | 8/1983 | Kohl et al. | 315/74 |
| 4,415,836 | 11/1983 | De Cuester et al. | 315/74 |
| 4,500,811 | 2/1985 | McMillan | 315/74 |

*Primary Examiner*—Michael Day
*Attorney, Agent, or Firm*—Brown & Wood, LLP

[57] ABSTRACT

A conductive pin (4) for an illumination lamp is made of CuNi-alloy including by weight, 10–30% Ni and 70–90% Cu.

2 Claims, 1 Drawing Sheet

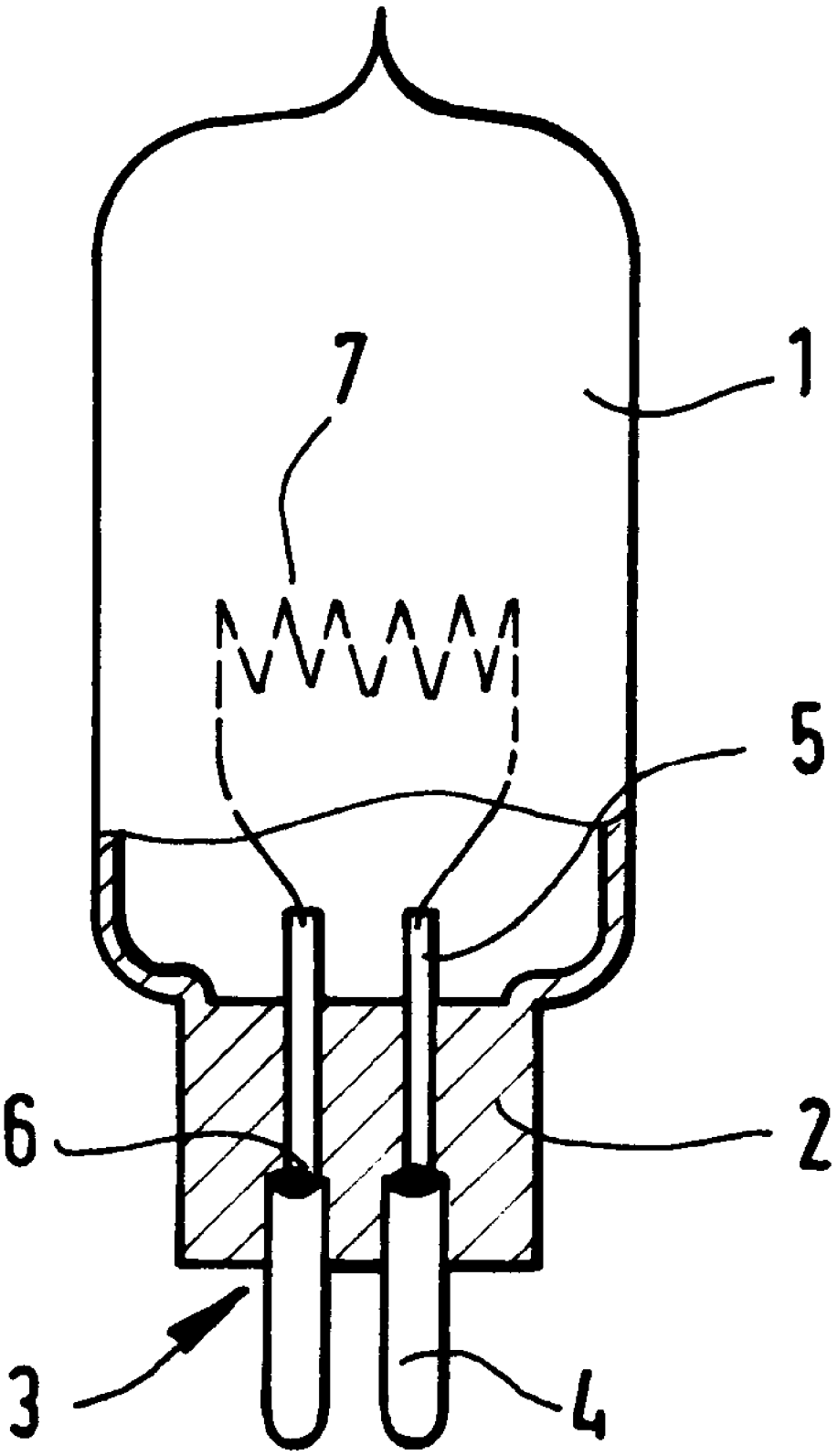
7
1
5
6
2
3
4

CONDUCTIVE PINS FOR AN ILLUMINATION LAMP

BACKGROUND OF THE INVENTION

1. Field of the Invention

The present invention relates to a current lead-in conductor for an illumination lamp with a glass base, which conductor is made of nickel (Ni)-containing alloy, and to an illumination lamp containing such a conductor.

2. Description of the Prior Art

Illumination lamps include incandescent lamps, gas discharge lamps, flash lamps and the like. An illumination lamp has a hollow glass body and a substantially massive or solid glass base connected with the hollow glass body. The current lead-in conductor is partially fused into the glass base and partially projects outwardly from the base. The current lead-in conductor is a heavy solid body made of an appropriate alloy. The known current lead-in conductors for the illumination lamps are made of an alloy consisting of 98% Ni by weight and 2% Mn by weight. Nickel is a rather expensive metal and, of course, it is desirable to be able to make the current lead-in conductors of a cheaper material. However, the current lead-in conductors should meet certain requirements which the desired cheap materials (substitute metals) should satisfy. These requirements are:

The use of a substitute metal should not make the production of the current lead-in conductors more difficult.

The substitute metal should, during fusing-in of the conductor into the glass base, withstand the fusing temperatures of about 1,200° C.

The substitute metal should have a good electrical conductance to insure current supply into the interior of the illumination lamp.

The substitute metal should have a good heat conductance to be able to carry away heat from the lamp interior.

The substitute metal should be able to withstand operational temperatures of 150–200° C. which prevail at the outwardly projecting portion of the current lead-in conductor.

The substitute metal should have a very good corrosion resistance in the presence of oxygen and heat.

Accordingly, an object of the present invention is to provide a relatively cheap metallic material for making the current lead-in conductors which would meet all of the above-listed requirements.

SUMMARY OF THE INVENTION

This and other objects of the present invention is achieved by using for making the current lead-in conductors a Ni-containing alloy comprising 10–30% Ni by weight and 70–90% Cu by weight.

Because of the high content of copper the alloy, which is used for producing the current lead-in conductors, is rather cheap, e.g., 20% cheaper than alloy including 98% of nickel or pure nickel. Extensive experiments have shown that the current lead-in conductor made of CuNi-alloy having high content of copper is still capable of meeting all of the production, fusing and operational temperatures, and corrosion resistance requirements as well as the requirements with regard to electrical and heat conductance. While the current lead-in conductor according to the present invention, because of properties of the alloy it is made of, has somewhat lower values of the electrical and heat conductance than the conventional current lead-in conductors made of NiMn-alloy, both the electrical conductance and the heat conductance of the CuNi-alloy of which the current lead-in conductors according to the present invention are made, are still very much acceptable.

The CuNi-alloy is per se known and is available on the market. The alloy of which the current lead-in conductors according to the present invention is made can contain other metals, e.g., up to 10% by weight, e.g., Fe and/or Mn. The best characteristics of the current lead-in conductor according to the present invention are achieved when the CuNi-alloy of which the conductor is made, contains maximum 20% Ni by weight.

Generally, the current lead-in conductor according to the present invention is made of a drawn wire and has a diameter up to 4 mm and a length up to 400 mm. The known current lead-in conductors also have these dimensions.

As a rule, the current lead-in conductor according to the present invention is welded, at an end thereof extending in the glass base to a lead-in wire.

The current lead-in conductor and the a lead-in wire form together a current lead-in, which itself is finished product. The lead-in wire is made e.g., of molybdenum, tungsten or a FeNi-wire having a copper packet (DUMET™).

The current lead-in conductor according to the present invention is relatively easy welded to the lead-in wire. The lead-in wire is partially fused-into the lamp glass base and projects into the interior of the lamp.

BRIEF DESCRIPTION OF THE DRAWINGS

The features and objects of the present invention will become more apparent, and the invention itself will be best understood from the following detailed description of the preferred embodiment when read with reference to the accompanying drawings, wherein:

Single FIGURE shows schematically a side, partially cross-sectional view of an illumination lamp, together with lead-in current conductors, according to the present invention.

DETAILED DESCRIPTION OF THE PREFERRED EMBODIMENT

An illumination lamp according to the present invention, which is shown in the drawing has a hollow glass body 1 which smoothly passes into a massive glass base 2. Two current lead-ins 3 are cast-into the glass base 2. Each lead-in 3 consists of a current conductive pin 4 and a lead-in wire 5 the cross-section of which is smaller than that of the conductive pin 4. The adjacent ends of the conductive pin 4 and the lead-in wire 5 abut each other and are connected with each other by a weld 6. Both sealed pins project into the glass body 1, with their free ends carrying a filament 7 made of tungsten.

The conductive pin 4 itself is formed of a copper-nickel alloy having 10–30% of nickel by weight and 70–90% of copper by weight. The conductive pin 4 are formed of sections of drawn wire and have a diameter up to 4 mm, and a length up to 400 mm.

Though the present invention was shown and described with reference to the preferred embodiment, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. An illumination lamp, comprising a hollow glass body having a solid glass base; and two lead-in conductors fused into the glass base and having each a portion projecting outwardly from the glass base, wherein the outwardly projecting portion of the lead-in conductor is made of a CuNi alloy comprising 10–30% Ni by weight and 70–90% Cu by weight.

2. An illumination lamp according to claim 1, wherein each lead-in conductor is formed of a lead-in metal wire fused into the glass base and having an end thereof projecting into a hollow of the glass body, and a conductive pin having a first portion thereof extending into the glass base and welded to an end of the lead-in wire opposite to the end of the lead-in wire projecting into the hollow of the glass body, and a second portion projecting outwardly from the glass base and forming the outwardly projecting portion of the lead-in conductor.

* * * * *